US009090379B2

(12) United States Patent
Nelson

(10) Patent No.: US 9,090,379 B2
(45) Date of Patent: Jul. 28, 2015

(54) PALLET DEVICE WITH SUPPORT RIBS

(71) Applicant: Duane Nelson, Spartanburg, SC (US)

(72) Inventor: Duane Nelson, Spartanburg, SC (US)

( * ) Notice: Subject to any disclaimer, the term of this patent is extended or adjusted under 35 U.S.C. 154(b) by 153 days.

(21) Appl. No.: 14/159,540

(22) Filed: Jan. 21, 2014

(65) Prior Publication Data

US 2014/0130720 A1 May 15, 2014

(51) Int. Cl.
*B65D 19/00* (2006.01)
*B65D 19/44* (2006.01)

(52) U.S. Cl.
CPC ..... *B65D 19/44* (2013.01); *B65D 19/0026* (2013.01); *B65D 2519/00019* (2013.01); *B65D 2519/00054* (2013.01); *B65D 2519/0086* (2013.01); *B65D 2519/00124* (2013.01); *B65D 2519/00273* (2013.01); *B65D 2519/00288* (2013.01); *B65D 2519/00323* (2013.01); *B65D 2519/00333* (2013.01); *B65D 2519/00442* (2013.01); *B65D 2519/00562* (2013.01); *B65D 2519/00567* (2013.01); *B65D 2519/00815* (2013.01)

(58) Field of Classification Search
USPC ..... 108/51.3, 55.3, 56.1, 51.11, 57.18
See application file for complete search history.

(56) References Cited

U.S. PATENT DOCUMENTS

| | | | | | |
|---|---|---|---|---|---|
| 2,709,559 | A | | 5/1955 | Geisler | |
| 2,908,464 | A | | 10/1959 | Traudt et al. | |
| 2,997,266 | A | * | 8/1961 | Munroe | 108/51.3 |
| 3,012,747 | A | * | 12/1961 | Greene | 108/51.3 |
| 3,131,656 | A | | 5/1964 | Houle | |
| 4,502,597 | A | * | 3/1985 | Cantey | 108/51.3 |
| 4,570,546 | A | * | 2/1986 | Batelka | 108/51.3 |
| 4,936,229 | A | | 6/1990 | Parnell | |
| 4,979,446 | A | | 12/1990 | Winebarger | |
| 5,029,734 | A | * | 7/1991 | Nichols | 108/55.3 |
| 5,129,329 | A | | 7/1992 | Clasen | |
| 5,176,090 | A | * | 1/1993 | Roberts et al. | 108/51.3 |
| 5,184,558 | A | | 2/1993 | Wozniacki | |
| 5,357,875 | A | | 10/1994 | Winebarger | |
| 5,441,154 | A | * | 8/1995 | Youell, III | 108/51.3 |
| 5,469,795 | A | | 11/1995 | Moorman | |
| 5,483,875 | A | * | 1/1996 | Turecek et al. | 108/51.3 |
| 5,487,345 | A | | 1/1996 | Winebarger | |
| 5,531,165 | A | * | 7/1996 | Taravella et al. | 108/51.3 |
| 5,537,935 | A | * | 7/1996 | Otaguchi et al. | 108/51.3 |
| 5,568,774 | A | | 10/1996 | Hutchison | |
| 5,784,971 | A | | 7/1998 | Chang | |
| 6,079,337 | A | | 6/2000 | Huang et al. | |
| 6,155,181 | A | | 12/2000 | Ghilcutt | |

(Continued)

FOREIGN PATENT DOCUMENTS

EP 0598540 5/1994

*Primary Examiner* — Jose V Chen
(74) *Attorney, Agent, or Firm* — John B. Hardaway, III; Amy Allen Hinson; Nexsen Pruet, LLC

(57) ABSTRACT

A pallet device for storing and shipping goods is disclosed. The pallet device may include a planar surface having a top and a bottom. The pallet device further may include cross braces having two openings extending therethrough and separated by a partition. The partition includes a row of slits that each extend along the depth of the cross brace. The lower surface of the cross brace also may include a row of slits that each extend along the width of the cross brace. The cross brace is secured to the bottom of the planar surface. The pallet device also includes a plurality of ribs that are each inserted into a slit of the partition as well as a slit of the lower surface of the cross brace.

29 Claims, 7 Drawing Sheets

(56) References Cited

U.S. PATENT DOCUMENTS

| | | | | |
|---|---|---|---|---|
| 6,612,247 | B1 | 9/2003 | Pistner et al. | |
| 6,739,270 | B1 | 5/2004 | Sewell | |
| 7,000,549 | B2 | 2/2006 | Nelson | |
| 2005/0247240 | A1* | 11/2005 | Nelson | 108/51.3 |
| 2007/0227410 | A1* | 10/2007 | Chen | 108/51.3 |
| 2008/0295747 | A1* | 12/2008 | Vinderola | 108/51.3 |

* cited by examiner

PALLET DEVICE WITH SUPPORT RIBS

BACKGROUND

The present invention relates generally to the field of pallets. More particularly, the present invention relates to pallets that securely store a load of goods typically for shipping and storage of such goods.

Pallets for use in storage and shipping are widely used in almost every industry that involves the transport of goods. Pallets vary in size, configuration, and material. For example, pallets composed of wood, metal, plastic, and paper are known.

Pallets composed of paper-type material, such as cardboard, are ideal for storage and shipping of goods in many industries because of the ability to break-down and then store the pallets as well as the ability to recycle the material after use. Furthermore, cardboard pallets typically weight significantly less than pallets made of other materials thereby substantially reducing shipping weights and costs. Pallets made of cardboard, however, are typically not as strong and durable as pallets made of other materials such as wood, metal, and plastic.

While various pallets are known, there is a need for a pallet composed of paper-type material that is strong and durable enough for use in shipping and storage of goods.

SUMMARY

The present invention includes a pallet device for storing goods. In one embodiment of the invention, the pallet device includes a planar surface having a top and a bottom. The pallet device further includes at least two foldable cross braces for securing to the bottom of the planar surface. The cross braces each have a length and a width as well as a first row of first slits extending along the length of the cross brace and a second row of second slits also extending along the length of the cross brace. The pallet device also includes a plurality of ribs. Each of the ribs is for insertion into a first slit of the first row of first slits and a second slit of the second row of second slits when the cross brace is folded.

In an alternative embodiment of the invention, the pallet device includes a planar surface having a top and a bottom. The pallet device further includes at least two cross braces each having a length, a width, and a depth. Each of the cross braces further have an upper surface, a lower surface, two sides, and a partition all extending along the length of the cross brace and forming two openings extending along the length of the cross brace. The openings are positioned adjacent to each other along the width of the cross brace and are separated by the partition. The partition includes a first row of first slits wherein each first slit extends along the depth of the cross brace. Further, the lower surface includes a second row of second slits wherein each second slit extends along the width of the cross brace. The upper surface of the cross brace is for securing to the bottom of the planar surface. The pallet device also includes a plurality of ribs. Each of the ribs is for insertion into a first slit of the first row of first slits and a second slit of the second row of second slits.

The present invention also includes a cross brace for use with a pallet device. In one embodiment of the invention, the cross brace includes an upper surface, a first lower surface, a second lower surface, two sides, and a partition all extending along an entire length of the cross brace and forming two openings extending along the length of the cross brace. The openings are positioned adjacent to each other along a width of the cross brace and are separated by the partition. The first lower surface is positioned at a first depth of the cross brace and the second lower surface is positioned at a second depth of the cross brace wherein the first depth is greater than the second depth. The partition includes a first row of first slits and the first and second lower surfaces includes a second row of second slits wherein each second slit extends along the width of the cross brace and is perpendicular to the first slits of the partition. Further, the cross brace includes at least three first lower surfaces along the length of the cross brace and at least two second lower surfaces along the length of the cross brace whereby the first and second lower surfaces alternate along the length of the cross brace.

DETAILED DESCRIPTION OF REPRESENTATIVE EMBODIMENTS

The present invention is related to a pallet device that is particularly suitable for storing and shipping goods. Although primarily described herein in terms of its use for storing and shipping goods, it will be clear that the present invention may be used for a variety of other purposes. The invention will be described with reference to the figures forming an integral non-limiting part of the instant specification. Throughout the description similar elements will be numbered accordingly.

Figure 1:
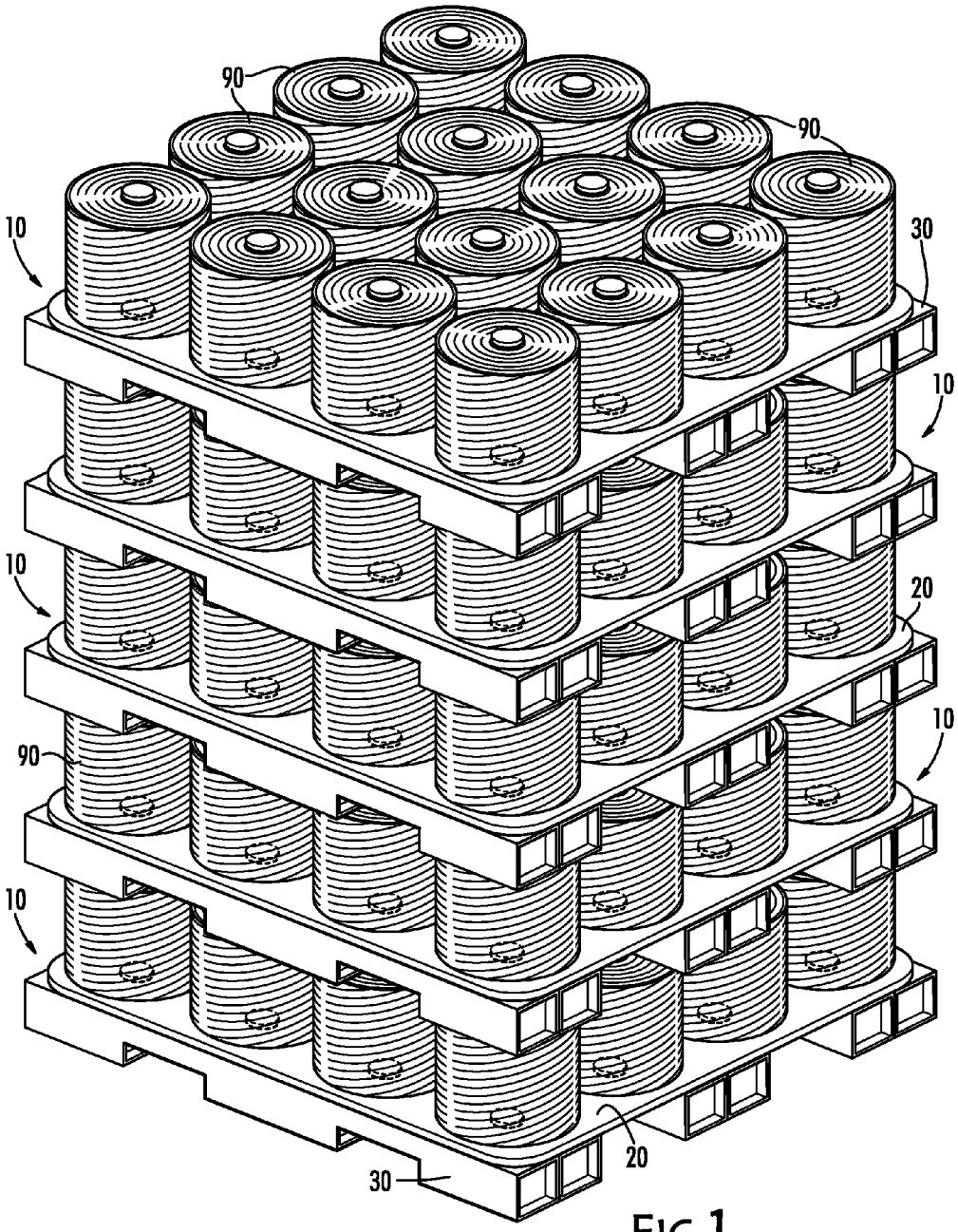
FIG. 1 is a perspective view of several stacked pallet devices according to an embodiment of the present invention with goods stored therebetween and thereon.

FIG. 1 discloses an embodiment of the pallet device 10 of the present invention. Several pallet devices 10 are in a stacked arrangement with goods 90, such as spindled material, positioned between and on the pallet devices 10. It will be understood that several different types of goods may be used in connection with the pallet device 10 and such goods are not limited to goods that appear or are sized similar to goods 90. Further, while the disclosed embodiment includes five stacked pallet devices with goods stacked therebetween and thereon, a single pallet device may be used for storing and shipping goods as well as more or fewer than five pallet devices. The number of pallet devices used typically depends on the types of goods loaded on the pallet device as well as the space available for storing and/or shipping the goods.

Figure 2:
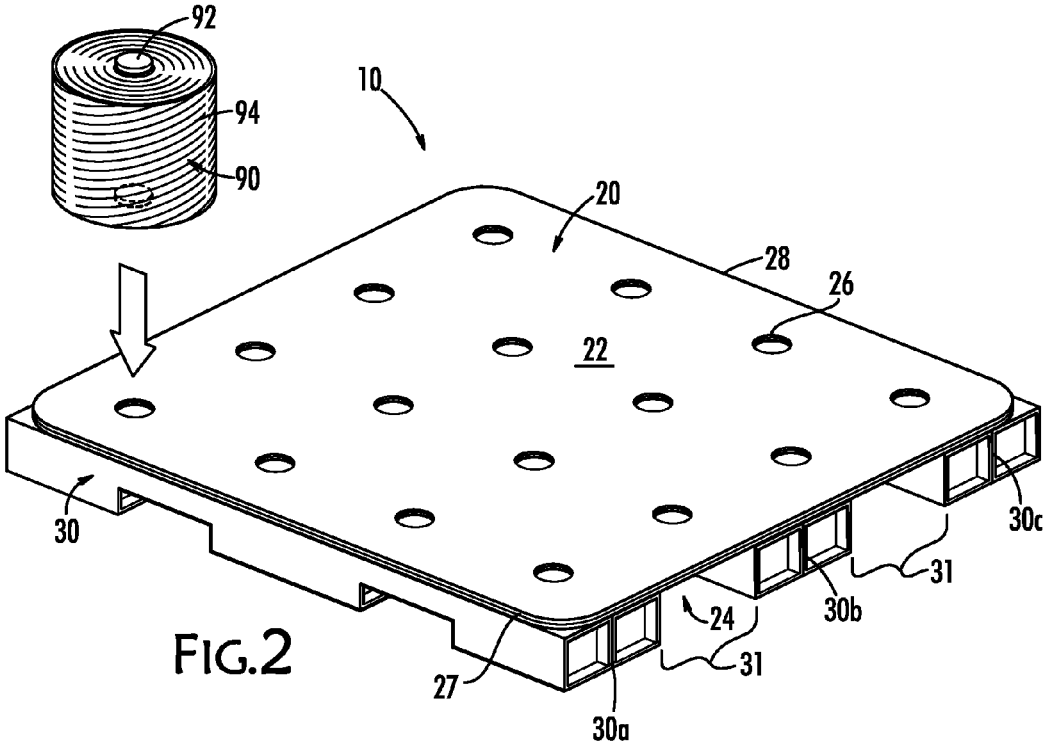
FIG. 2 is a perspective view of the pallet device according to an embodiment of the present invention and demonstrating how goods may be secured thereto.

FIG. 2 discloses an embodiment of a pallet device 10. In this embodiment, the pallet device 10 may include a planar surface 20 having a top 22 and a bottom 24. The planar surface may include openings 26 for securing goods 90 to the pallet device 10. Here, the goods 90 have a spindle type structure 92 running through the center of material 94. The spindle type structure 92 extends beyond the material 94 so that an end of the spindle type structure 92 may be inserted into an opening 26 of the planar surface 20 of pallet device 10. By inserting the spindle type structure 92 into the opening 26 of the planar surface, the goods 90 are securely positioned on pallet device 10.

In the embodiment disclosed in FIG. 2, the openings are circular. In an alternative embodiment, the openings are square or rectangular. It will be understood that several different shapes and configurations of openings may be used and the number of openings may vary. Furthermore, the planar surface may be constructed without openings and securing techniques other than openings may be used to secure goods to the pallet device. For examples, simply the weight of the goods may secure it to the pallet device. Further, straps may be used. In the disclosed embodiment the planar surface 20 is approximately square shaped with rounded corners. The shape of the planar surface however also may vary.

Figure 3:
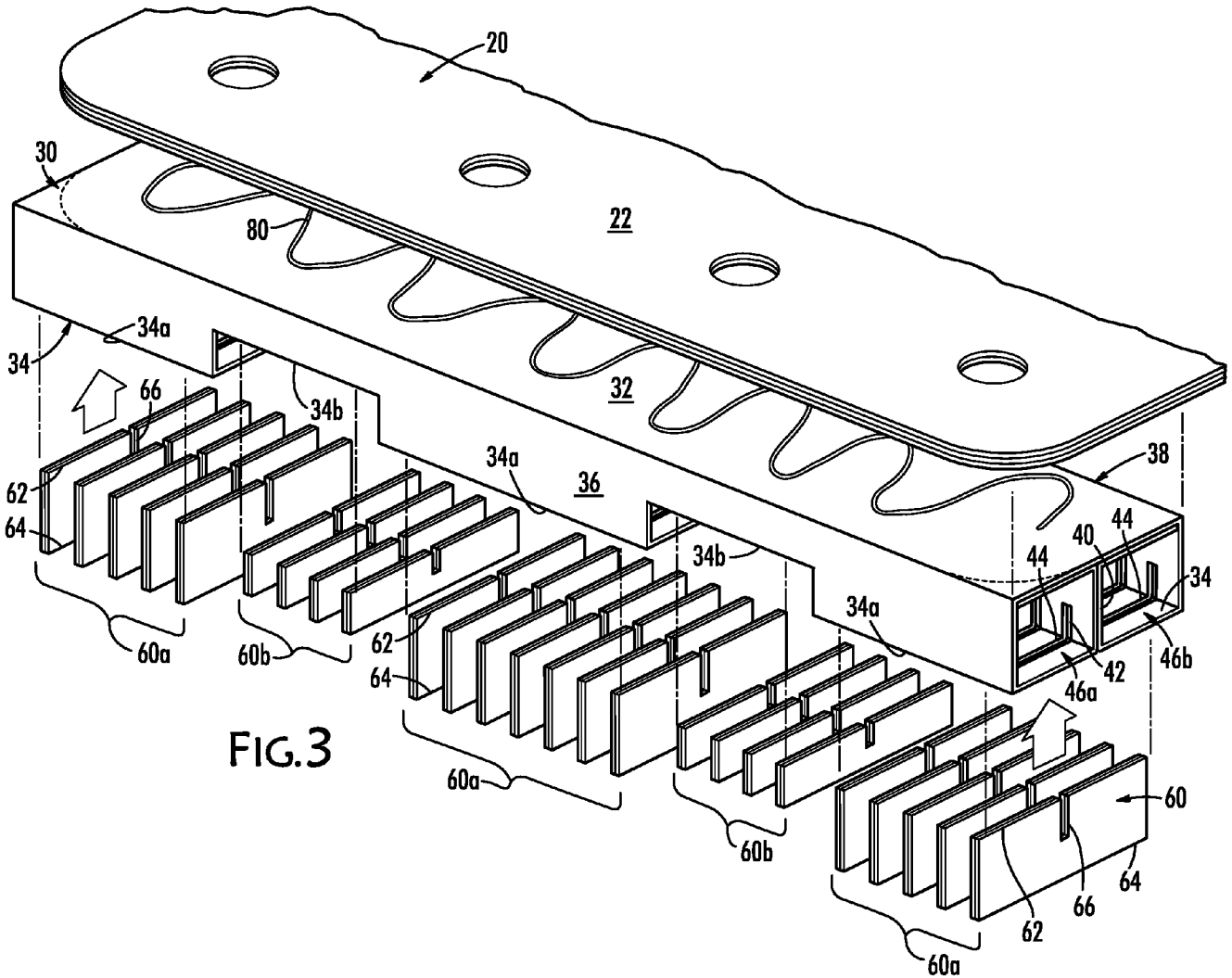
FIG. 3 is an exploded perspective view of the pallet device according to an embodiment of the present invention showing how the pallet device may be secured together.

As shown in FIGS. 2 and 3, the pallet device 10 may also include cross braces 30 secured to the bottom 24 of planar surface 20. A number of securing techniques may be used to secure cross braces 30 to the bottom 24 of planar surface 20. For example, as shown in FIG. 3, adhesive material 80, such as heavy duty glue, may be incorporated between the cross brace 30 and the bottom of planar surface 20 to secure them together. In the embodiment disclosed in FIGS. 1 and 2, each pallet device 10 includes three cross braces 30; however, the number of cross braces incorporated into a pallet device may vary. In these embodiments, the cross braces are secured transversely across the bottom 24 of the planar surface 20 in parallel relationship with space or gaps 31 between each cross brace 30. For example, a first cross brace 30*a* is positioned at a first end 27 of the planar surface, a second cross brace 30*c* is positioned at a second opposing end 28 of the planar surface, and a third cross brace 30*b* is positioned along a middle centerline of the planar surface 20 so that it is approximately equidistant from the other two cross braces 30*a* and 30*c* .When a pallet device includes more or less than three cross braces, a different arrangement may be used. For example, when only two cross braces are used, both cross braces may be positioned at or near the ends 27, 28 of planar surface 20 with no cross braces extending down the centerline of planar surface 20. Further, when four cross braces are used, two cross braces may be positioned each at or near the ends 27, 28 of planar surface 20 and the remaining two cross braces may be positioned equidistant between the cross braces positioned on the ends of planar surface 20. When three or more cross braces are used, it is preferred that the cross braces are equally spaced along planar surface 20 however such equal spacing is not necessary. Further, in the disclosed embodiment, each cross brace 30 is approximately identically dimensioned and each cross brace 30 extends approximately the entire length of planar surface 20. The dimensions of each cross brace used in a pallet device 10 of the present invention may vary and may only partially extend along the planar surface 20 or extend beyond the planar surface 20. Moreover, several cross braces may be combined to extend a determined length of the planar surface 20, which may be particularly useful when shipping or storing very large objects.

Figure 4:
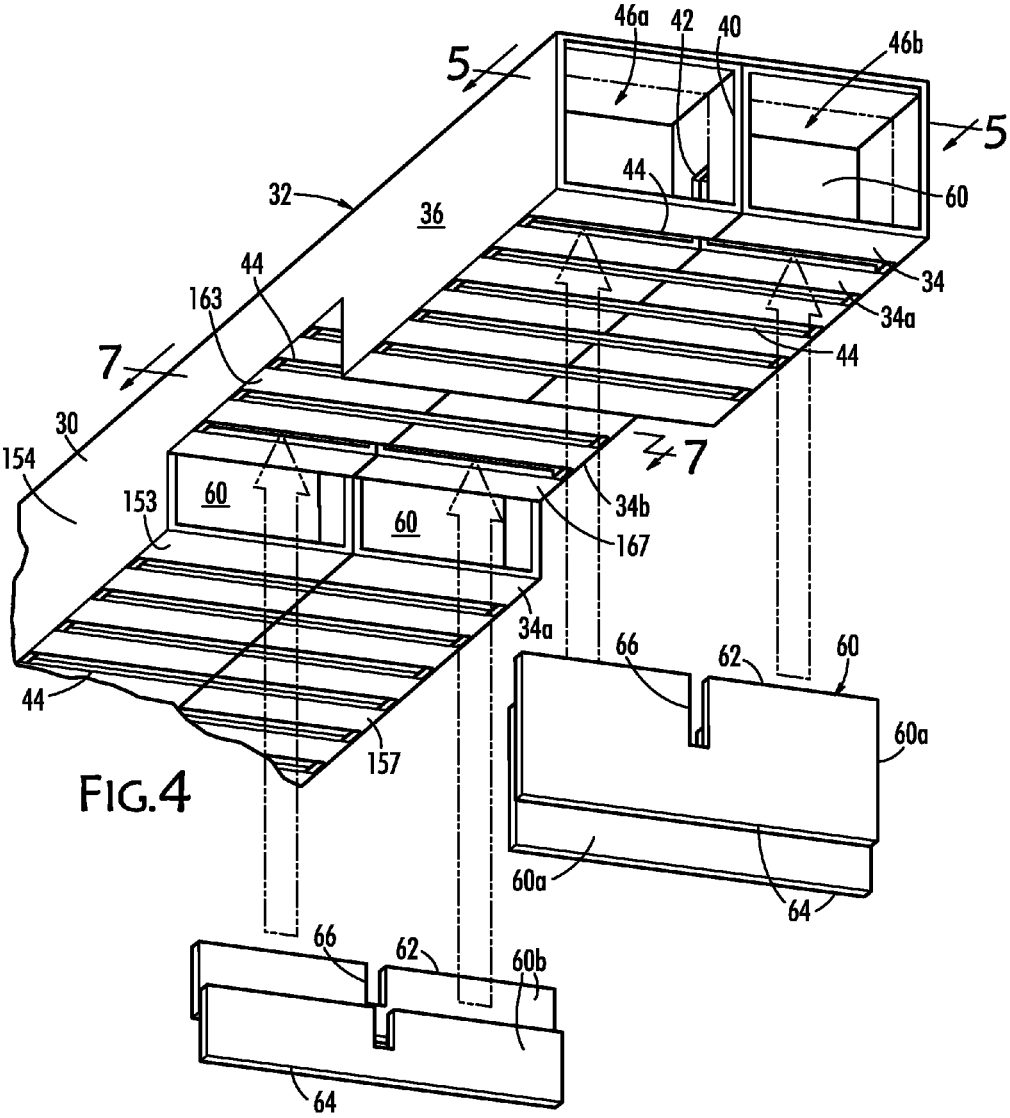
FIG. 4 is an exploded perspective view of the cross brace and ribs according to an embodiment of the present invention showing how the ribs may be inserted into the cross brace.

As shown in FIGS. 3 and 4, the cross brace 30 of the pallet device 10 has a length, a width, and a depth. Furthermore, the embodiment of the cross brace 30 disclosed in FIGS. 3 and 4 has an upper surface 32, a lower surface 34, a first side 36, a second opposing side 38, and a partition 40 that all extend along the length of the cross brace 30. The upper surface 32 of the cross brace 30 may be secured to the bottom of the planar surface 20 as shown in FIG. 3 and discussed above. The upper surface 32, lower surface 34, two sides 36, 38, and partition 40 all form two openings 46*a*, 46*b* that are separated by partition 40 and positioned adjacent to each other in side-by-side relation along the width of the cross brace 30. Further, the two openings 46*a*, 46*b* also both extend along the length of the cross brace 30.

The partition 40 may include a row of slits 42. The row of slits 42 of partition 40 preferably extends along the length of the cross brace 30 and each slit preferably extends along the depth of the partition 40 from the lower surface 34 towards the upper surface 32. In the disclosed embodiment, the slits 42 of partition 40 only extend approximately half the depth of cross brace 30 and therefore do not extend all the way to upper surface 32. In an alternative embodiment, the slits of partition 40 extend approximately three-quarters of the depth of cross brace 30, and, in yet another embodiment, the slits of partition 40 extend approximately one-quarter of the depth of cross brace 30.

Further, the lower surface 34 may also include a row of slits 44. The row of slits 44 of lower surface 34 preferably extends along the length of the cross brace 30 and each slit preferably extends along the width of the cross brace between the two sides 36 and 38. The slits 44 of the lower surface 34 may extend entirely across the lower surface 34 and width of cross brace 30 or the slits may only extend partially across the lower surface 34 and width of cross brace 30. Because the slits 42 of the partition extend along the depth of the cross brace 30 and the slits 44 of the lower surface extend along the width of the cross brace 30, slits 42 are perpendicular to slits 44.

As shown in FIGS. 3, the pallet device may include ribs 60. The ribs 60 provide additional structural integrity and support to the pallet device. Ribs 60 may be inserted into the pallet device 30 through slits 44 of the lower surface 34 and slits 42 of the partition 40. Ribs 60 therefore preferably have a width of less than or equal to the width of slits 44 of lower surface 34. Ribs 60 may extend the entire width of cross brace 30 or only partially across the width of cross brace 30. In the disclosed embodiment, ribs 60 are rectangular in shape having an upper surface 62 and a lower surface 64. Ribs 60, however, may be shapes other than rectangular and/or each have varying shapes. For example, in one embodiment, the ribs 60 are trapezoidal in shape. Further, as more further discussed below, the ribs 60 may vary in size and dimension.

Ribs 60 may include one or more slots 66. In the embodiment of FIG. 3, only one slot 66 is shown that is positioned along the centerline width of rib 60. Slot 66 however may be positioned in other locations along the width of rib 60, particularly if more than one slot is included on a rib. Further, slot 66 preferably only extends partially from the upper surface 62 of rib 60 towards but not all the way to the lower surface 64 of rib 60. In the embodiment disclosed in FIG. 3, slot 66 extends from the upper surface 62 of rib 60 to approximately halfway between the upper surface 62 and lower surface 64. The slot 66 of rib 60 is preferably positioned and configured to be in line with the slits 42 of the partition 40 of the cross brace 30.

The number, location, and configuration of slot 66 may depend upon the slits 42 of the partition and slits 44 of the lower surface of cross brace 30. For example, to provide the most structural integrity when inserted into cross brace 30, the ribs 60 may extend from the upper surface 32 all the way to the lower surface 34 of cross brace 30 so that opening 46 is entirely blocked by rib 60. To do this in an embodiment such as discussed in FIG. 4, the slot 66 of rib 60 must have a depth from the upper surface 62 of rib 60 that is at least as deep as the distance between the top of slit 42 of partition 40 all the way to the upper surface 32 of cross brace 30. Further, the distance between the bottom of the slot 66 and the lower surface 64 of rib 60 must be as deep as slit 42 of partition 40. FIGS. 5 through 8 disclose a rib 60 with a slot 66 that is sized to extend from the upper surface 32 all the way to the lower surface 34 of cross brace 30. In some embodiments, however, ribs 60 and slot 66 may be sized to extend only partially between upper surface 32 and lower surface 34 of cross brace 30. Further, rib 60 may be sized to only partially extend between sides 36 and 38 of cross brace 30.

As shown in the embodiments of the pallet device of FIGS. 1 through 4, the cross brace may include a portion with a full depth and a portion with a more shallow depth. Thus, the pallet device may have a first lower surface portion 34*a* positioned at the full depth and a second lower portion 34*b* positioned at the more shallow depth. In the embodiment disclosed in FIG. 3, the more shallow depth is approximately half of the full depth. Further, in the illustrated embodiment, the cross brace 30 includes three first lower surface portions 34*a* and two second lower surface portions 34*b* that alternate along the length of the cross brace 30. The depths, however, may vary and the number of depths and lower surface portions may also vary. For example, the cross brace 30 may include four distinct depths extending along the length of cross brace 30.

When the depths vary such as shown in the embodiment of FIGS. 3 and 4, the depths of the ribs 60 may also vary accordingly. For example, FIG. 4 discloses a first set of ribs 60*a* for insertion into the lower surface portion 34*a* having a first depth of cross brace 30 and a second set of ribs 60*b* for insertion into the other lower surface portion 34*b* having a second more shallow depth of cross brace 30. Since the second more shallow depth is approximately half the depth of the first depth of cross brace 30, the ribs 60*b* may also be approximately half the depth of the ribs 60*a*. The ribs 60*a*, 60*b* may be inserted into the slits of the lower surfaces 34*a*, 34*b* of cross brace 30, respectively, as shown by the arrows.

Figure 5:
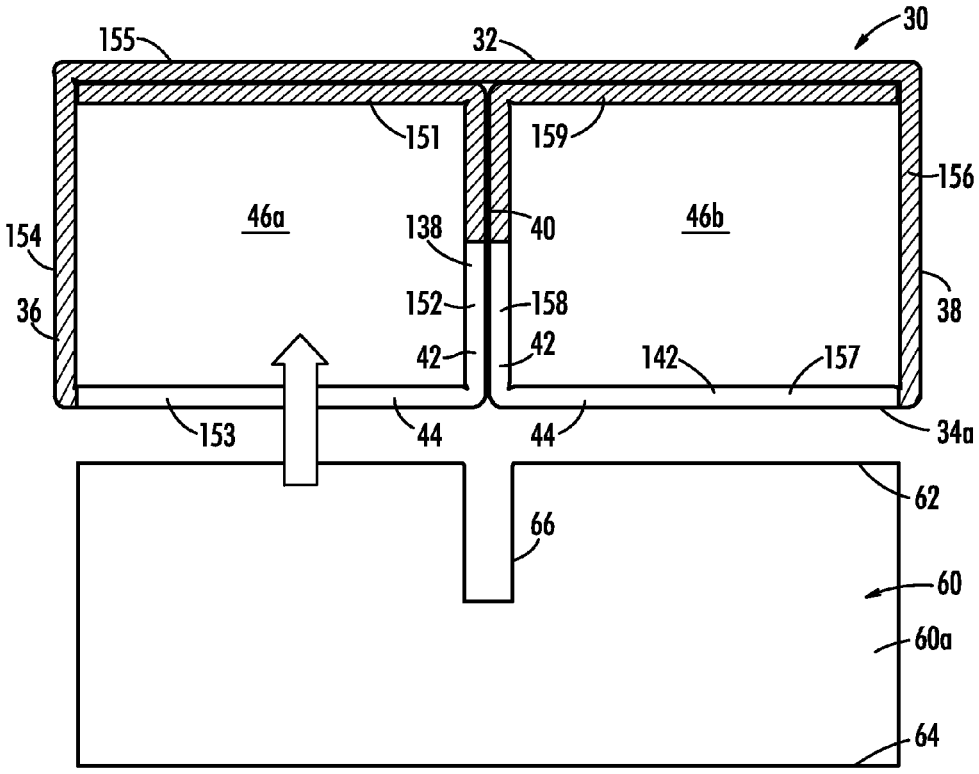
FIG. 5 is a front elevation view of the embodiment of the cross brace and rib taken at line 5-5 of FIG. 4 showing how the rib may be inserted into the cross brace.
Figure 6:
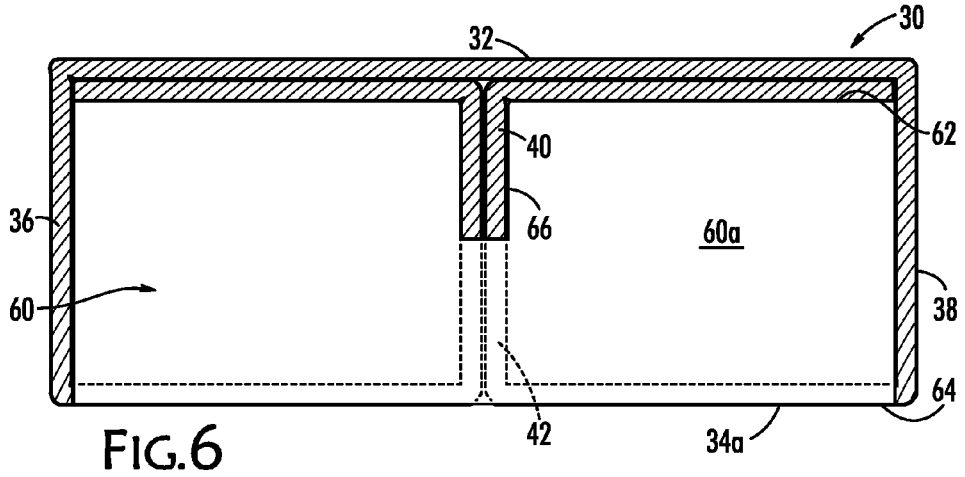
FIG. 6 is a front elevation view of the embodiment of the cross brace and rib of FIG. 5 showing the rib inserted into the cross brace.

FIGS. 5 and 6 further discloses the positioning and inserting of rib 60*a* into a slit 44, 42 of lower surface 34*a* and partition 40, respectively. FIGS. 5 and 6 are cross sections of the embodiment of the cross brace 30 of FIG. 4 taken along line 5-5. FIG. 5 shows the cross brace 30 prior to insertion of rib 60*a* with rib 60*a* positioned below lower surface portion 34*a*. The rib 60*a* is inserted in the direction of the arrow of FIG. 5 into the slits 44, 42 of lower surface 34*a* and partition 40, respectively. FIG. 6 shows the rib 60*a* fully inserted into the cross brace 30. As discussed above, this embodiment discloses the ribs 60*a* covering the entire openings 46*a*, 46*b* formed by the cross brace sides, surfaces, and partition 32, 34, 36, 38, and 40. In some embodiments, the ribs 60*a*, however, may not cover the entire openings 46*a*, 46*b*.

Figure 7:
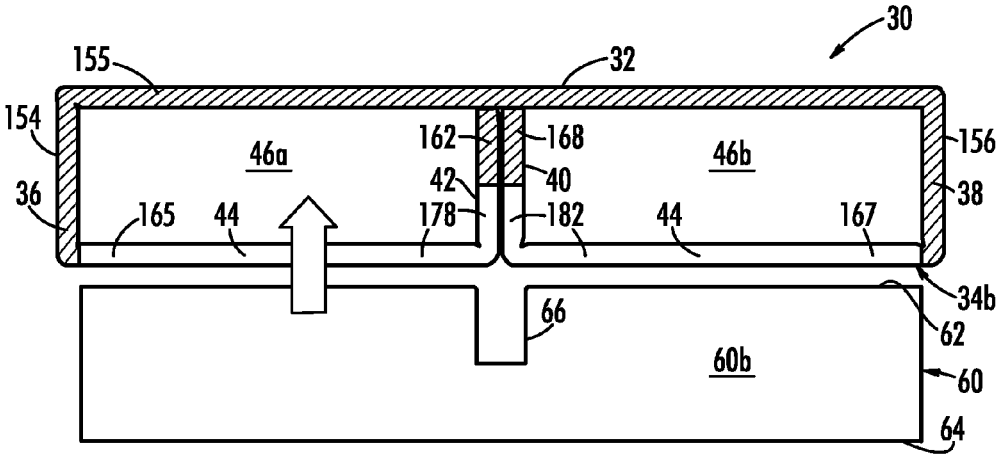
FIG. 7 is a front elevation view of the embodiment of the cross brace and rib taken at line 7-7 of FIG. 4 showing how the rib may be inserted into the cross brace.
Figure 8:
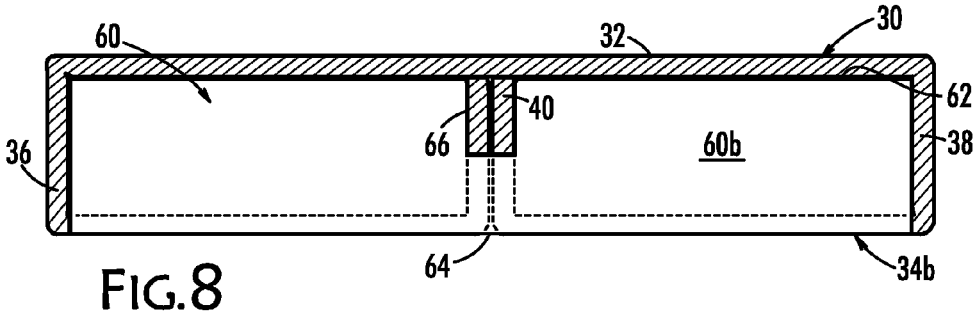
FIG. 8 is a front elevation view of the embodiment of the cross brace and rib of FIG. 7 showing the rib inserted into the cross brace.

FIGS. 7 and 8 discloses the positioning and inserting of rib 60*b* into a slit 44, 42 of lower surface 34*b* and partition 40, respectively. FIGS. 7 and 8 are cross sections of the embodiment of the cross brace 30 of FIG. 4 taken along line 7-7. FIG. 7 shows the cross brace 30 prior to insertion of rib 60*b* with rib 60*b* positioned below lower surface portion 34*b*. The rib 60*b* is inserted in the direction of the arrow of FIG. 7 into the slits 44, 42 of lower surface 34*b* and partition 40, respectively. FIG. 8 shows the rib 60*b* fully inserted into the cross brace 30. As discussed above, this embodiment discloses the rib 60*b* covering the entire openings 46*a*, 46*b* formed by the cross brace sides, surfaces, and partition 32, 34, 36, 38, and 40. In some embodiments, the ribs 60*b*, however, may not cover the entire openings 46*a*, 46*b*.

Figure 9:
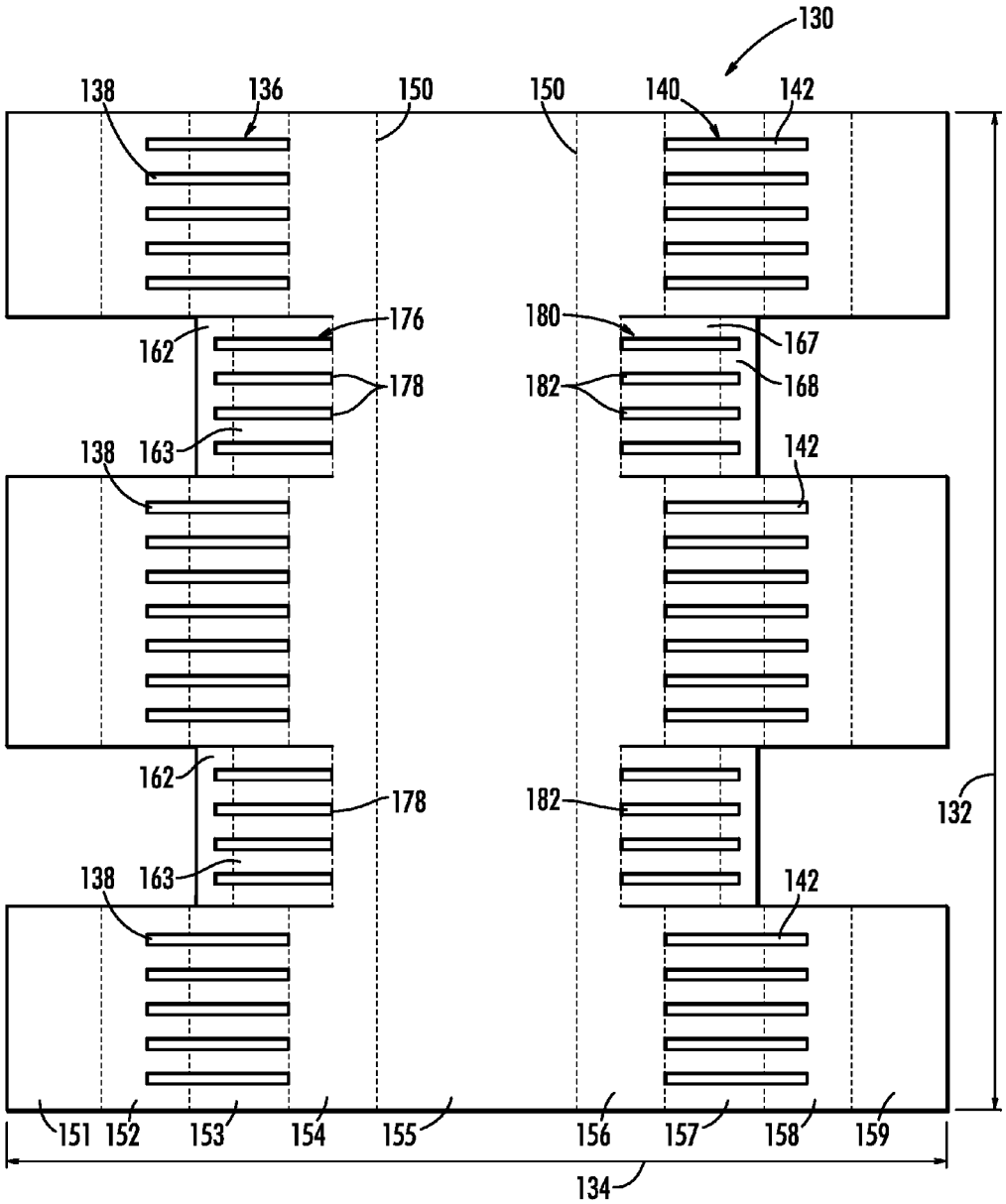
FIG. 9 is a plan view of an embodiment of the cross brace prior to being formed.

FIG. 9 discloses an embodiment of a foldable cross brace 130 prior to folding. The embodiment of the cross brace of FIG. 9 may be formed of a paper-like foldable material such as a lightweight corrugated cardboard. Other foldable materials, however, may be used without departing from the scope of the invention. The prefolded cross brace 130 may have a length 132 and a width 134. Further, the prefolded cross brace 130 may include a first row 136 of slits 138 extending along the length of the prefolded cross brace 130 and a second row 140 of slits 142 also extending along the length of the prefolded cross brace 130.

Further, the prefolded cross brace 130 may include die cuts 150 extending along its length. In the embodiment of FIG. 9, the die cuts 150 separate nine sections of the cross brace identified as 151, 152, 153, 154, 155, 156, 157, 158, and 159. The cross brace may be formed by folding along the die cuts 150 to form a cross brace 30 such as shown in FIGS. 4 that includes an upper surface 32, a lower surface 34, two sides 36 and 38, and a partition 40 all extending along an entire length of the cross brace 36 and forming two openings 46*a* and 46*b* also extending along the length of the cross brace 30. The openings 46*a* and 46*b* may be positioned adjacent to each other along the width of the cross brace 30 and separated by the partition 40.

FIGS. 4, 5, and 7 disclose an example of a cross brace 30 formed by folding cross brace 130. Section 155 is the center section and forms upper surface 32. Section 154 may be folded downward so that it is perpendicular to center section 155 and forms a first side wall 36. Section 153 may then be folded inward so that it is perpendicular to section 154 and parallel to center section 155 but in a separate plane below center section 155. Section 153 thereby forms a lower surface 34. Section 152 may next be folded so that it is parallel to section 154 but in a separate plane and runs in between and perpendicular to sections 155 and 153. Section 152 thereby forms a center partition 40. Finally, section 151 may be folded inward to position it directly adjacent and parallel to center section 155. Section 151 thereby forms an inner wall of upper surface 32 and section 155 forms an outer wall of upper surface 32.

The opposing sections 156, 157, 158, and 159 may then or simultaneously be folded similar to sections 151, 152, 153, and 154. For example, section 156 may be folded downward so that it is perpendicular to center section 155 and forms a second side wall 38 running parallel to first side wall 36 and partition 40. Section 157 may then be folded inward again so that it is perpendicular to section 156 and parallel to center section 155 and preferably in the same plane as section 153. Section 157 thereby also forms lower surface 34. Section 158 may next be folded so that it is parallel to sections 154 and 156 and preferably directly adjacent and parallel to section 152. Section 158 therefore forms center partition 40 with section 152. Finally, section 159 is folded inward and is positioned adjacent and parallel to center section 155. Section 159 thereby forms an inner wall of upper surface 32 similar to and preferably in the same plane with section 151.

Moreover, in the embodiment disclosed in FIG. 9, the first row of slits 136 extend partially across section 152 and completely across section 153. As shown in FIG. 5, when cross brace 130 is folded, slits 138 of the first row of slits 136 form an "L" shape entirely across the lower surface 34 and partially upward into partition 40. Likewise, the second row of slits 140 extend partially across section 158 and completely across section 157. When cross brace 130 is folded, slits 142 of the second row of slits 140 also form an "L" shape entirely across the lower surface 34 and partially upward into partition 40. Thus, the combination of slits 138 and 142 in sections 153 and 157, respectively, of prefolded cross brace 130 combine to create slits 44 across the lower surface 34 of the folded cross brace 30. Further, the combination of slits 138 and 142 in sections 152 and 158, respectively, of prefolded cross brace 130 combine to create slits 42 in the partition 40 of the folded cross brace 30.

The embodiment of the prefolded cross brace of FIG. 9, may be folded to form multiple lower surfaces 34. For example, the disclosed embodiment folds to form three first lower surface portions 34*a* along the length of the cross brace and two alternating second lower surface portions 34*b* along the length of the cross brace such as shown in FIG. 3. To provide multiple depths, the prefolded cross brace 130 may include additional sections 162 and 163 carrying a third row 176 of slits 178 extending along the length of the prefolded cross brace 130. In the disclosed embodiment, the slits 178 of the third row of slits 176 have a width smaller than the slits 138 of the first row of slits 136 and are positioned inward in relation to the first row of slits 136. The third row of slits 176 may alternate between portions of the first row of slits 136. In the embodiment of FIG. 9, section 162 is approximately one-third to one-half the width of section 152 and is positioned in line with a portion of section 153. Further, section 163 is approximately the width of section 153 with a portion extending under a portion of section 153 and another portion extending under a portion of section 154. When prefolded cross brace 130 is folded, section 163 is folded inward similar to section 153 but is in a plane above section 153 so that two lower surfaces are formed having a first depth and a second depth as shown in FIGS. 3 and 4. For example, section 163 may be folded to form lower surface 34*b* and section 153 may be folded to form lower surface 34*a* wherein the depth from lower surface 34*b* to upper surface 32 is approximately half the depth from lower surface 34*a* to upper surface 32. In the embodiment disclosed in FIG. 4, the slits of the lower surface 34*b*, however, are the same width as the slits of the lower surface 34*a* because section 153 and 163 are approximately the same width. Section 162 may be folded upward similar to section 152 and forms the partition 40 rising upward from lower surface 34*b*. In the embodiment disclosed in FIG. 4, and more clearly shown in FIG. 7, the slit 42 in folded cross brace 30 is more shallow from lower surface 34*b* because the slit 178 in section 162 is more narrow in width than the slit 138 in section 152.

To provide multiple depths, the prefolded cross brace 130 may also include additional sections 167 and 168 carrying a fourth row 180 of slits 182 extending along the length of the prefolded cross brace 130. In the disclosed embodiment, the slits 182 of the fourth row of slits 180 have a width smaller than the slits 142 of the second row of slits 140 and are positioned inward in relation to the second row of slits 140. The fourth row of slits 180 may alternate between portions of the second row of slits 140. In the embodiment of FIG. 9, section 168 is approximately one-third to one-half the width of section 158 and is positioned in line with a portion of section 157. Further, section 167 is approximately the width of section 157 with a portion extending under a portion of section 157 and another portion extending under a portion of section 156. When prefolded cross brace 130 is folded, section 167 is folded inward similar to section 157 but is in a plane above section 157 so that two lower surfaces are formed having a first depth and a second depth as shown in FIGS. 3 and 4 and similar to the first and second depths formed by sections 153 and 163, respectively. For example, section 167 may be folded to form a further portion of lower surface 34*b* and section 157 may be folded to form a further portion of lower surface 34*a* wherein the depth from lower surface 34*b* to upper surface 32 is approximately half the depth from lower surface 34*a* to upper surface 32. In the embodiment disclosed in FIG. 4, the slits of the lower surface 34*b*, however, are the same width as the slits of the lower surface 34*a* because section 157 and 167 are approximately the same width. Section 168 may be folded upward similar to section 158 and forms another portion of the partition 40 rising upward from lower surface 34*b*. In the embodiment disclosed in FIG. 4, and more clearly shown in FIG. 7, the slit 42 in folded cross brace 30 is more shallow from lower surface 34*b* because the slit 182 in section 168 is more narrow in width than the slit 142 in section 158.

As shown in the embodiment of the prefolded cross brace 130 of FIG. 9, the slits 138 of the first row of slits 136 may be in-line along the width 134 of the prefolded cross brace 130 with the slits 142 of the second row of slits 140. Similarly, the slits 178 of the third row of slits 176 may be in-line along the width 134 of the prefolded cross brace 130 with the slits 182 of the fourth row of slits 180. Further, the distance between the first and second rows of slits 136 and 140, respectively, along the width 134 of the prefolded cross brace 130 may be greater than the distance between the third and fourth rows of slits 176 and 180, respectively, along the width 134 of the prefolded cross brace 130.

Once the prefolded cross brace 130 is folded, ribs 60, including ribs 60*a* and/or 60*b* may be inserted into the cross brace as discussed above. Thus, referring to the slits of the prefolded cross brace 130, each of the ribs 60 may be inserted into a slit 138 of the first row of slits 136 as well as a slit 142 of the second row of slits 140 when the cross brace 130 is folded. Further, if two depths are included, each of the ribs 60*a* may be inserted into a slit 138 of the first row of slits 136 as well as a slit 142 of the second row of slits 140 and each of the ribs 60*b* may be inserted into a slit 178 of the third row of slits 176 as well as a slit 182 of the fourth row of slits 180 when the cross brace 130 is folded.

The pallet device 10 may be composed of several different materials without departing from the scope of the invention. For example, the pallet device or portions thereof may be composed of paper products such as corrugated cardboard. Such an embodiment is beneficial because it may be light weight and recyclable after use. In an alternative embodiment, the pallet device or portions thereof may be composed of composite materials. The pallet device may be assembled from two stamping. The size of each stamping may change with the size of the pallet. For example, the pallets may range from full, half, and quarter-pallet sizes, based on a common 47"×47" standard. In some circumstances, industry standard single wall (double face) corrugated board may be used although double wall and tri-wall board may also be used and suitable for heavier use.

The type and amount of adhesive or securing means between the planar surface 20 and the cross brace 30 depend upon the material of such portions of the pallet device as well as the intended use of the pallet device. For example, when paper type material is used to construct the pallet device for maritime transport, wet strength paper type material and water-resistant glue or other securing techniques may be used to secure planar surface 20 and cross brace 30. In one embodiment, glue guns, rollers, and/or brushes may be used to apply adhesive between planar surface 20 and cross brace 30. Further, in one embodiment, no adhesive is used to secure ribs 60 in cross brace 30. In an alternative embodiment, adhesive is used to strengthen the connection between ribs 60 and cross brace 30.

The pallet device 10 may be used with a fork lift or pallet truck. For example the tines of a fork lift or pallet truck may be inserted into openings 46. Alternatively, when three cross braces are used in a pallet device, such as shown in FIGS. 1 and 2, two spaces 31 may be formed across the pallet device between the cross braces. The tines of the fork lift or pallet truck may be inserted into these spaces 31. Further, when two depths are used in a cross brace, the tines of the fork lift may be inserted below the second lower surface 34*b*, thereby making the pallet device accessible by a fork lift or pallet truck on all sides. Where the fork lift tines are inserted may also depend upon the size of the load and the need for extra support. When a fork lift picks up a pallet device, multiple pallet devices may be stacked with or without goods for storing and/or shipping.

The pallet devices may be printed with a bar code or an RFID may be used to assist in tracking the pallets or goods thereon in a plant, warehouse, or loading dock.

For recycling, the pallets may be crushed, shredded or otherwise modified for ease of shipment to a recycling plant.

It should be noted that there are several configurations suitable for the design of pallet device 10 and components thereof. Further, the number of cross braces, ribs, slits, openings, pallet devices, and other features and components discussed above and shown in the drawings are for example only and represent but some of the configurations. Other configurations altering the number and positions of such devices and components could be employed to demonstrate the invention. All configurations known in the art are intended to be encompassed by the present invention and the description and drawings shouadhnot be deemed to narrow the scope of the present invention in any way.

While various embodiments of the present invention have been described above, it should be understood that they have been presented by way of example, and not limitation. It will be apparent to persons skilled in the relevant art(s) that various changes in form and detail can be made therein without departing from the spirit and scope of the present invention. In fact, after reading the above description, it will be apparent to one skilled in the relevant art(s) how to implement the invention in alternative embodiments. Thus, the present invention should not be limited by any of the above described exemplary embodiments.

In addition, it should be understood that the figures, which highlight the functionality and advantages of the present invention, are presented for purposes of example only. The architecture of the present invention is sufficiently flexible and configurable, such that it may be used in ways other than that shown in the accompanying figures.

Further, the purpose of the Abstract of the Disclosure is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The Abstract of the Disclosure is not intended to be limiting as to the scope of the invention in any way.

What is claimed is:

1. A pallet device for storing goods comprising:

a planar surface having a top and a bottom;

at least two foldable cross braces for securing to said bottom of said planar surface, said cross braces each having a length and a width, each of said cross braces further having a first row of first slits extending along said length of said cross brace and a second row of second slits also extending along said length of said cross brace; and a plurality of ribs, each of said ribs for insertion into a first slit of said first row of first slits and a second slit of said second row of second slits when said cross brace is folded, wherein each of said cross braces further includes a third row of third slits extending along said length of said cross brace said third row of third slits are positioned in alternating relationship with said first row of first slits.

2. The pallet device of claim 1 wherein said planar surface has openings on said top for securing goods to said pallet device.

3. The pallet device of claim 1 wherein said cross braces include die cuts extending along said length, said cross braces are foldable along said die cuts.

4. The pallet device of claim1 wherein said third row of third slits are positioned in alternating relationship within said first row of first slits, said third row of third slits having a width smaller than a width of said first row of first slits.

5. The pallet device of claim 1 wherein each of said cross braces further includes a fourth row of fourth slits extending along said length of said cross brace, said fourth row of fourth slits are positioned in alternating relationship with said second row of second slits.

6. The pallet device of claim 5 wherein said first slits are in line with said second slits along the width of said cross brace and said third slits are in line with said fourth slits along the width of said cross brace.

7. The pallet device of claim 6 wherein the distance between said first slits and said second slits along the width of said cross brace is greater than the distance between said third slits and said fourth slits along the width of said cross brace.

8. The pallet device of claim 7 wherein said plurality of ribs include first ribs and second ribs, each of said first ribs for insertion into a first slit of said first row of first slits and a second slit of said second row of second slits when said cross brace is folded, each of said second ribs for insertion into a third slit of said third row of third slits and a fourth slit of said fourth row of fourth slits when said cross brace is folded.

9. The pallet device of claim 8 wherein said first ribs have a depth greater than said second ribs.

10. The pallet device of claim 5 wherein said fourth row of fourth slits are positioned in alternating relationship within said second row of second slits, said fourth row of fourth slits having a width smaller than a width of said second row of second slits.

11. The pallet device of claim 1 wherein said ribs each include slots.

12. A pallet device for storing goods comprising:

a planar surface having a top and a bottom;

at least two cross braces, said cross braces each having a length, a width, and a depth, each of said cross braces further having an upper surface, a lower surface, two sides, and a partition all extending along the length of said cross brace and forming two openings extending along the length of said cross brace, wherein said openings are positioned adjacent to each other along the width of said cross brace and separated by said partition, said partition includes a first row of first slits wherein each first slit extends along the depth of said cross brace but not the entire depth of said cross brace, said lower surface includes a second row of second slits wherein each second slit extends along the width of said cross brace, said upper surface of said cross brace for securing to said bottom of said planar surface; and a plurality of ribs each comprising a partial third slit, each of said ribs for insertion into a first slit of said first row of first slits of said partition and a second slit of said second row of second slits of said lower surface, wherein when said ribs are fully inserted into said partition, said third slit of each of said ribs is positioned above a respective said first slit of said partition of said cross brace.

13. The pallet device of claim 12 wherein said planar surface has opening on said top for securing goods to said pallet device.

14. The pallet device of claim 12 wherein said plurality of ribs are inserted into said cross braces at said first and second slits.

15. The pallet device of claim 14 wherein said ribs block said openings extending along the length of said cross braces.

16. The pallet device of claim 14 wherein the upper surfaces of said at least two cross braces are secured to said bottom of said planar surface.

17. The pallet device of claim 16 wherein said cross braces are secured to said planar surface by adhesive material.

18. The pallet device of claim 16 wherein three cross braces are secured to said bottom of said planar surface in parallel relationship, wherein a first cross brace is positioned at a first end of said planar surface, a second cross brace is positioned at an opposing second end of said planar surface, and a third cross brace is positioned along a centerline of said planar surface.

19. The pallet device of claim 18 wherein said cross braces have spaces therebetween.

20. The pallet device of claim 12 wherein said depth of said cross brace includes a first depth and a second depth and said lower surface of said cross brace includes a first lower surface and a second lower surface, wherein said first lower surface is positioned at said first depth and said second lower surface is positioned at said second depth, said first depth is greater than said second depth.

21. The pallet device of claim 20 wherein each of said cross braces include at least three first lower surfaces along said length of said cross brace and at least two second lower surfaces along said length of said cross brace, said first lower surface and said second lower surfaces alternate along said length of said cross brace.

22. The pallet device of claim 20 wherein said plurality of ribs includes first ribs having a third depth and second ribs having a fourth depth, said third depth is greater than said fourth depth, said first ribs for insertion in said first and second slits at said first lower surface of said cross brace and said second ribs for insertion in said first and second slits at said second lower surface of said cross brace.

23. The pallet device of claim 22 wherein said first and second ribs are inserted in said first and second slits of said cross braces and the upper surfaces of said at least two cross braces are secured to said bottom of said planar surface.

24. A cross brace for use with a pallet device, said cross brace comprising:

an upper surface, a first lower surface, a second lower surface, two sides, and a partition all extending along an entire length of said cross brace and forming two openings extending along said length of said cross brace;

said openings are positioned adjacent to each other along a width of said cross brace and separated by said partition;

said first lower surface is positioned at a first depth of said cross brace and said second lower surface is positioned at a second depth of said cross brace wherein said first depth is greater than said second depth;

said partition includes a first row of first slits;

said first and second lower surfaces includes a second row of second slits wherein each second slit extends along the width of said cross brace and are perpendicular to said first slits of said partition;

wherein said cross brace includes at least three first lower surfaces along said length of said cross brace and at least two second lower surfaces along said length of said cross brace, said first lower surface and said second lower surface alternate along said length of said cross brace.

25. The cross brace of claim 24 further comprising a plurality of first ribs, each of said first ribs positioned within a first slit of said partition and a second slit of said first lower surface.

26. The cross brace of claim 25 further comprising a plurality of second ribs, each of said second ribs positioned within a first lit of said partition and a second slit of said second lower surface.

27. The cross brace of claim 26 wherein said first ribs have a third depth and said second ribs have a fourth depth, said third depth is greater than said fourth depth.

28. The cross brace of claim 27 wherein said first ribs each comprise a first slot, said first slot in line with said first slit of said partition.

29. The cross brace of claim 28 wherein said second ribs each comprise a second slot, said second slot in line with said first slit of said partition.

* * * * *